United States Patent [19]

Moore

[11] Patent Number: 4,786,893

[45] Date of Patent: Nov. 22, 1988

[54] METHOD AND APPARATUS FOR GENERATING RGB COLOR SIGNALS FROM COMPOSITE DIGITAL VIDEO SIGNAL

[75] Inventor: Robin B. Moore, Fremont, Calif.

[73] Assignee: Apple Computer, Inc., Cupertino, Calif.

[21] Appl. No.: 785,220

[22] Filed: Oct. 7, 1985

[51] Int. Cl.[4] ..... G09G 1/28

[52] U.S. Cl. ..... 340/703; 340/701; 340/702

[58] Field of Search ..... 340/703, 701, 702, 704, 340/705, 728; 358/26, 27, 28

[56] References Cited

U.S. PATENT DOCUMENTS

| | | | |
|---|---|---|---|
| 4,233,601 | 11/1980 | Hankins et al. | 340/703 |
| 4,278,972 | 7/1981 | Wozniak | 340/703 |
| 4,390,893 | 6/1983 | Russell et al. | 340/701 |
| 4,516,266 | 5/1985 | Christopher et al. | 340/701 |
| 4,559,531 | 12/1985 | Buynak | 340/703 |
| 4,584,572 | 4/1986 | Lambert, III | 340/728 |
| 4,604,614 | 8/1986 | Farr et al. | 340/728 |

*Primary Examiner*—John W. Caldwell, Sr.
*Assistant Examiner*—Mahmoud Fatahi-Yar
*Attorney, Agent, or Firm*—Blakely, Sokoloff, Taylor & Zafman

[57] ABSTRACT

An improved method and apparatus for converting a serial bit stream representative of a composite color video signal to RGB control signals is described. A sliding window is used to determine the video color for each new bit in the stream after the bits are rearranged to their proper order. As soon as a change in color is detected, the prior color is used until a predetermined condition occurs such as the passage of a predetermined number of bits. This prevents displaying of transitional colors which appear as shadows on the display.

21 Claims, 4 Drawing Sheets

METHOD AND APPARATUS FOR GENERATING RGB COLOR SIGNALS FROM COMPOSITE DIGITAL VIDEO SIGNAL

BACKGROUND OF THE INVENTION

1. Field of the Invention.

The invention relates to the generation of video color signals from digital signals.

2. Prior Art.

Over the past twenty years or so, there has been a requirement to interface the commonly used raster scan cathode ray tube to the digital outputs of a digital computer. An early example is shown in U.S. Pat. No. 3,345,458 which describes a system for digitally generating characters for a raster scan display.

In more recent years there was a need to provide an interface between a digital computer and a standard (NTSC) color display. The NTSC system relies on phase differences of analog signals which are not easily made compatible with digital signals from a computer. A circuit for converting digital signals to a direct composite color signal is described in U.S. Pat. No. 4,278,972. In this sytem, digital signals representing colors are shifted in a recirculating shift register in synchronous with the color reference signal (3.58 MHz). This system provides the composite video used in the Apple II series computers.

A more recent need has been to generate parallel color control signals such as those used in a red-green-blue (RGB) monitor from the digitally generated composite video. The RGB monitors have become more popular as their price has declined and since they provide better color displays. The composite video signal from, for example, an Apple II computer must be converted before it can be used for an RGB monitor or a color printer.

There is a commercially available apparatus described in conjunction with FIG. 1 for converting the composite color video generated by, for instance, the Apple II computer to parallel color control signals for an RGB monitor. The problems with this current apparatus will also be described in conjunction with FIG. 1.

SUMMARY OF THE INVENTION

A method and apparatus is described for converting a bit stream representing a color video signal to red, green and blue (RGB) color control signals for an RGB monitor or color monitor. In the preferred method, the colors represented by the serial bit stream are examined and compared to detect a change in color. When a change is detected, the color used prior to the change is repeated for a certain number of bits. Then the color indicated by the bit stream is used at some predetermined time or after the occurrence of a predetermined condition.

A sliding window is employed to determine the color represented by the bit stream. When the window extends between two color fields within the bit stream, the bits are rearranged to provide the color represented by the bit stream.

In the preferred apparatus the serial bit stream representing the composite video is coupled to a shift register. The parallel outputs of the shift register are coupled to a barrel shifter to rearrange the bits. This is done to provide the sliding window and rearranged bit field described above. The input bit stream is compared with the fourth stage of the register (where four bits are used for each color field) to detect a change of color.

Other aspects of the invention shall become apparent from the detailed description.

The invented method and apparatus provide concise color transition and eliminate the problems of the prior art conversion systems.

DETAILED DESCRIPTION OF THE INVENTION

A method and apparatus are described for converting a composite (serial) video bit stream to parallel control signals such as are used for an RGB monitor or color printer. In the following description, numerous specific details are set forth, such as specific number of bits, in order to provide a thorough understanding of the present invention. It will be obvious, however, to one skilled in the art that the present invention may be practiced without these specific details. In other instances, well-known methods and structures have not been set forth in order not to unnecessarily obscure the present invention.

In the following description the serial bit stream defining the NTSC color (chroma) is sometimes referred to as a composite video signal to distinguish it from the RGB signal. The synch signals and "front porch" color burst are well known and, hence, not discussed.

CURRENTLY EMPLOYED COMPOSITE VIDEO

Figure 1:
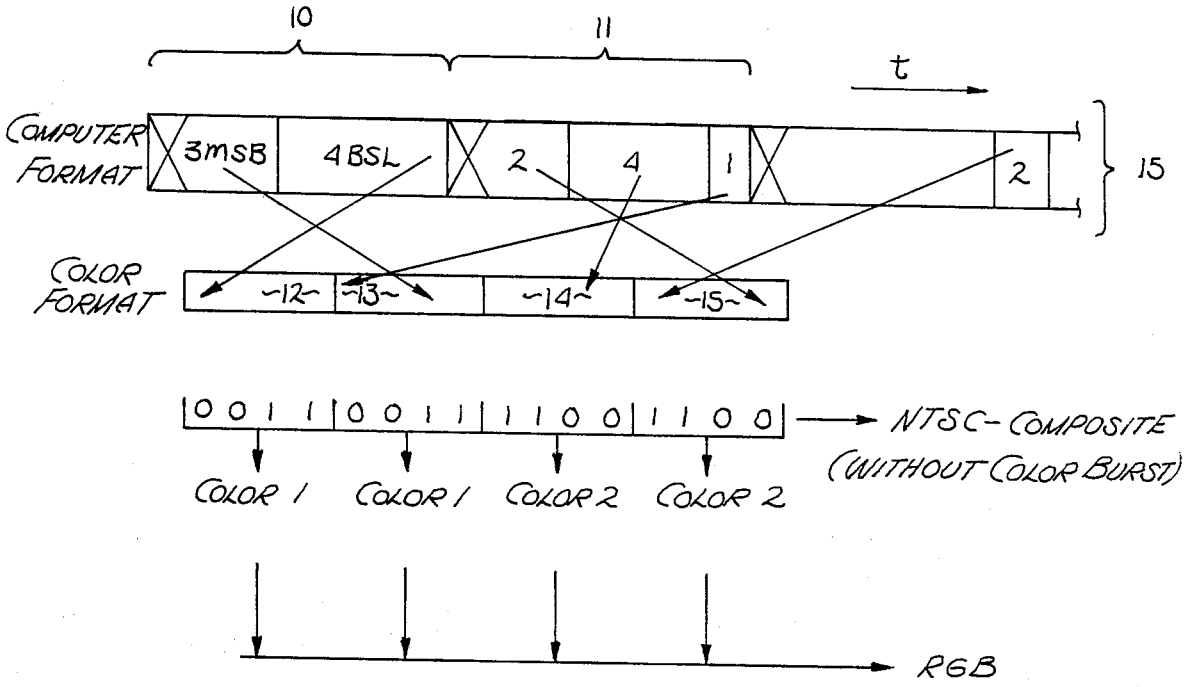
Fig. 1 (PRIOR ART)
FIG. 1 is the nature of a flow chart or graph used to describe the video signal currently employed in some computers.

In FIG. 1, the color video format used in one mode of a popular personal computer (Apple II) is shown. The format represented on line 15 shows a series of bytes such as bytes 10 and 11, representing the chroma position of a composite video signal. These bytes may be generated by shifting (in parallel) digital words representing colors into a shift register and then recirculating the words at a multiple of the color reference frequency. This is described in U.S. Pat. No. 4,278,972. In this format, four bits are used to describe a color and one bit in each byte is used for purposes not relevant to this discussion. With the particular format the zero, first, second and third bits of byte 10 form a color field 12 which represents a color shown as color 1. Bits 4, 5, 6 of byte 10 and bit 0 of byte 11 form the next color field 13. Similarly, the other bits from line 15 are used to form color fields of the color video signal. This signal can be used as an NTSC composite video signal when color bursts, etc., are added. The ones and zeros in this bit stream are treated as an analog signal and the phase of the signal is compared to the color reference signal to provide color control in a well-known manner. For example, as shown in FIG. 1, fields 14 and 15 would provide a "sine" wave when treated as an analog signal with zero phase shift with respect to the color reference signal. (For purposes of discussion, black and white are considered colors.) The fields 14 and 15 may contain the bit pattern 1100 which would represent a second color shown as color 2.

PRIOR ART METHOD OF CONVERTING THE SERIAL BIT STREAM TO PARALLEL SIGNALS FRO AN RGB MONITOR

In a commercially available conversion system for converitng the format of FIG. 1 to RGB signals, the four bits in each field are examined, the predetermined color represented by the bits is determined and then appropriate RGB signals are generated to control the monitor. For instance, 0011 representing color 1 may be directly applied to the monitor and typically the monitor contains a ladder network that would convert this signal to a particular color. The same is true for color 2 and all sixteen colors which can be represented by the four bit fields.

Figure 2:
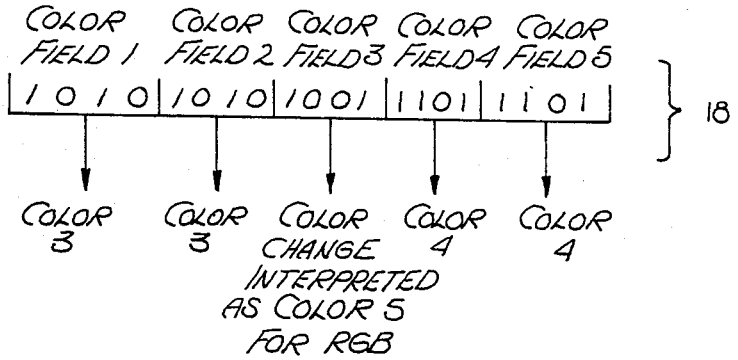
(PRIOR ART) Fig. 2
FIG. 2 shows a serial bit stream representing a video signal; this figure is used to describe prior art conversion to RGB signals and the problems with this conversion.

A problem resulting from the above described conversion is illustrated in FIG. 2. Five fields of a bit stream are shown in FIG. 2. Fields 1 and 2 represent color 3 and fields 4 and 5, a color 4. The intermediate field color field 3 contains the bits 1001. With the conversion method described above, 1001 is interpreted as another color (color 5) and thus on the video display another color appears between colors 3 and 4.

Color 5 of FIG. 2 may not and often is not intended as an additional color. It is simply the transition from color 3 to color 4 occurring in the midst of a color field. Color changes such as is shown in FIG. 2 do not necessarily being in a new frame. (It is more difficult to program the color transition at the field boundaries). On the video display with the prior art conversion, color 5 (or similar transitional colors) often appears as a shadow which results in blurred images. In some cases it is difficult to read some alphanumeric characters because of this blurring. It is this problem which is solved by the present invention.

OVERVIEW OF THE METHOD OF THE PRESENT INVENTION

Figure 3:
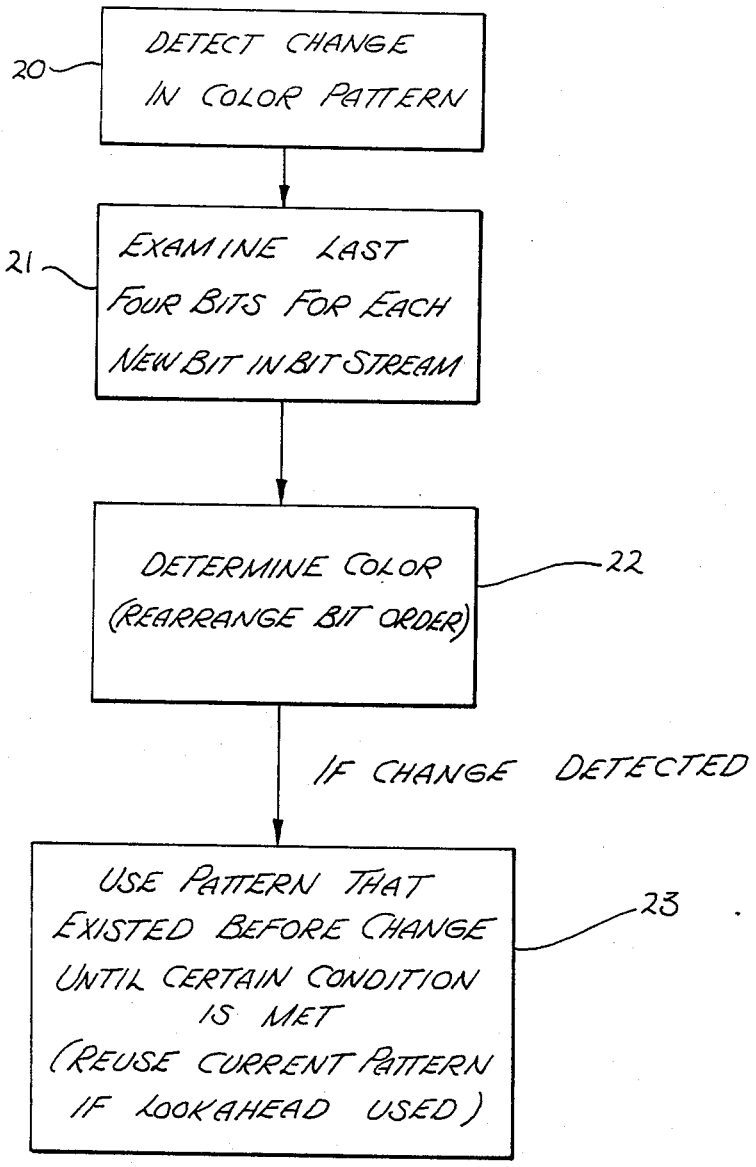
FIG. 3 is a block diagram showing the steps of the invented method.

In FIG. 3, blocks 20–23 represent the steps used in the invented method. As will be seen, these steps eliminate the blurring described in conjunction with FIG. 2. Again, the description is based on a four bit field; it will be apparent that both the invented method and apparatus can be used with any length fields.

With the preferred method, the incoming bit stream is examined to detect change in the color pattern. This is represented by block 20. Each new bit in the bit stream is used in this detection as will be seen with the apparatus of FIG. 4. As shown by block 21, the last four bits in the bit stream are examined and as shown by block 22, this is done to determine the color. This requires rearranging of the bits. For instance, if the color is contained in bits ABCD, the color is determined from these bits when in this order. When the next bit A arrives, the bit stream appears as BCDA. The bits are rearranged to again read ABCD to determine the color.

If a change in color is detected from block 20 the pattern that existed before the change is used until a certain or predetermined condition is met (block 23). Thus, if from the bit stream DABC a color change is detected the pattern that existed before this detected change (CDAB) after being reordered to ABCD is used as the color. After the predetermined condition is met, the color then being detected is used. This, in effect, eliminates the transition color.

Figure 4:
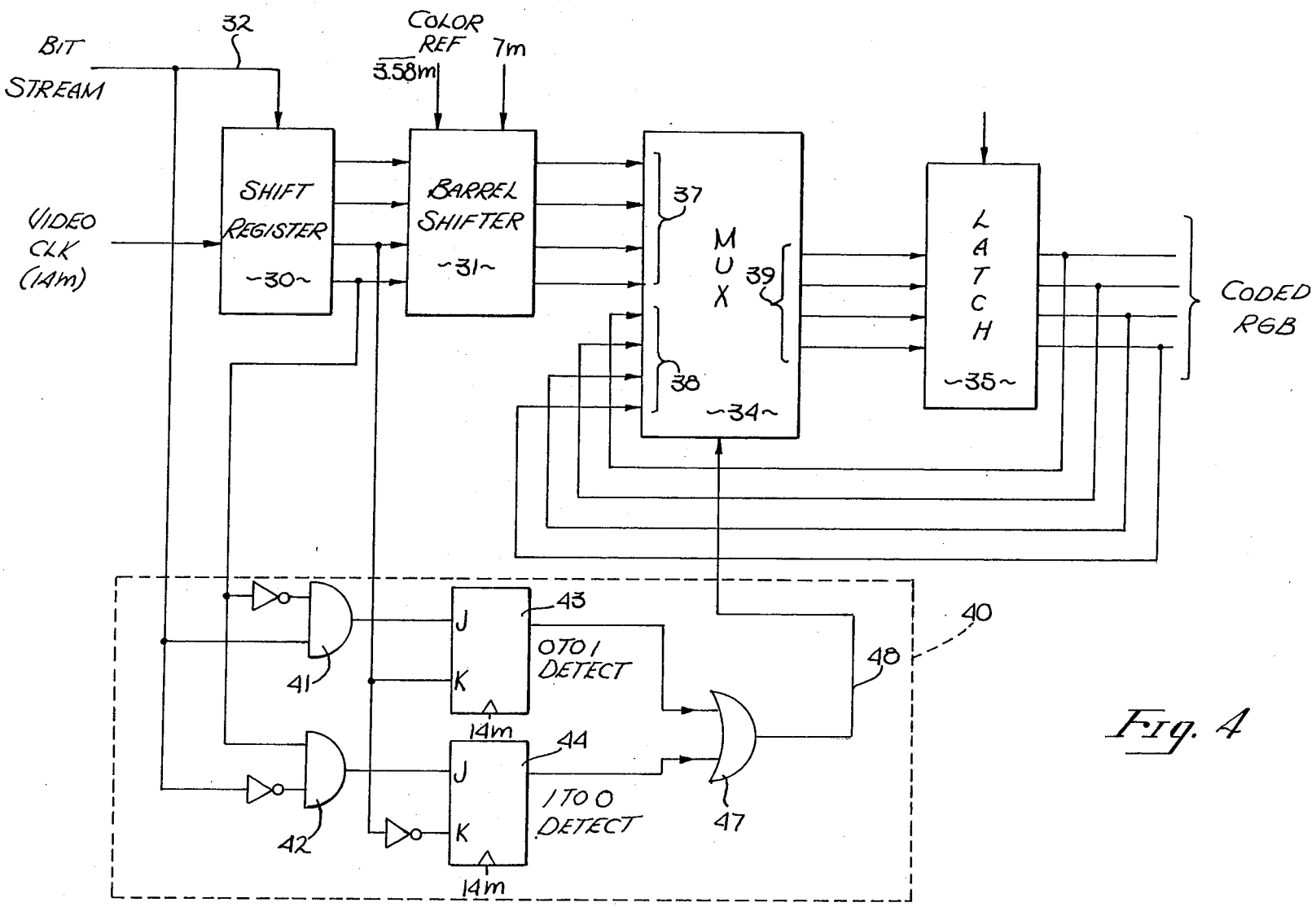
FIG. 4 is a block diagram used to describe the currently preferred apparatus embodying the present invention.

The predetermined condition can be an algorithm such as implemented in FIG. 4, or simply the passage of a predetermined number of bits.

PREFERRED EMBODIMENT OF THE PRESENT INVENTION

The block diagram of FIG. 4 in its current realization is fabricated in programmable array logic. Since such logic is difficult to use for explanation purposes, a block diagram as shown in FIG. 4 is used. It will be apparent to one skiled in the art that the block diagram of FIG. 4 may be made with discrete components, as an integrated circuit or in a programmable device such as a PAL.

The serial bit stream such as shown in FIG. 2 is coupled to the input of the shift register 30 via line 32. The bit stream is shifted in the four stages of this shift register under the control of the video clock (14 mHz). The four parallel outputs from the register 30 are coupled to a barrel shifter 31. The bits are shifted in the barrel shifter 31 under control of the two color timing signals, the 3.58 color reference signal and twice this reference signal. The output of the barrel shifter 31 is coupled to one set of input terminals 37 of multiplexer 34. The output terminals 39 of the multiplexer 34 are coupled to the input of latch 35. The output of latch 35 provides coded RGB signals. The four outputs of latch 35 are coupled to the other input terminals 38 of multiplexer 34.

The circuitry within dotted line 40 determines when a color change occurs and when a new color is to be selected. The incoming bit stream on line 32 is coupled to one input terminal of the AND gate 41 and is coupled to one input terminal of the AND gate 42 through an inverter. The fourth output line of the shift register 30 is coupled to the other iput terminal of the AND gate 41 through an inverter and is coupled to the other input terminal of the AND gate 42. The K terminals of these flip-flops receive the output from the third stage of register 30, with the output being inverted before being coupled to the flip-flop 44. The outputs of the flip-flops 43 and 44 provide inputs for the OR gate 47. The output line 498 of OR gate 47 controls multiplexer 34, that is, it determines which one of the input sets of terminals 37 or 38 are to be coupled to the output terminals 39.

OPERATION OF THE APPARATUS OF FIG. 4

In general, the shift register 30 takes the serial bit stream pattern and converts it to parallel form and provides the windowing, that is, creates a new four bit pattern each time a new bit enters the register. The barrel shifter 31 rearranges the bit in the correct order. This rearranging will be better understood in conjunction with FIG. 5. The color reference signal and twice this frequency contain the correct timing to rearrange the bits.

The comparator shown within dotted line 40 detects when a change occurs between the incoming bit stream 32 and the fourth bit in the shift register 30. Gates 41 and 42 perform this comparison since their inputs are receiving bits spaced-apart by four bits in the bit stream. When these two bits differ, it is known that a color change has occurred. When it occurs, the multiplexer 34 selects the contents of the latch 35 and recirculates the contents of that latch back through the multiplexer. This causes the previous color to be repeated. When no change is detected, the color from the barrel shifter 31 is fed through the multiplexer 39 into the latch 35.

As mentioned, the incoming bit stream on line 32 is continually compared with the fourth bit of the register through the AND gates 41 and 42. This in effect provides a look ahead into the bit stream on line 32. If the bits in each of the color fields are the same, there will be no output from the gates. However, as soon as a color change occurs, an ouptut will occur from these gates.

The K terminal of the flip-flops 43 and 44 are coupled to receive the third bit of the register 30. (This signal is inverted before being coupled to the K terminal of the flip-flop 44.) The flip-flops 43 and 44 compare two bits in the bit stream which are spaced-apart by four bit periods. There is a one clock cycle difference (14 mHz clock) between the data at the inputs to gates 41 and 42 and the data at the K inputs to the flip-flops 43 and 44. The flip-flop 43 detects a 0-1 change while flip-flop 44 detects a 1-0 change. When either of these changes occur, there is an output from the OR gate 47 which causes the multiplexer 48 to select the output of the latch, as mentioned.

With this embodiment of the present invention, a fixed number of cycles is not used when a change occurs. Rather, the current color is retained until the comparison in the bit stream bits indicates no change. Thus, if the bit stream changed from all ones to all zeros, all ones would be used for four cycles after the zeros began. With other color transitions, the prior color will be used for fewer cycles and in some cases, a count of fringe color may occur.

Figure 6:
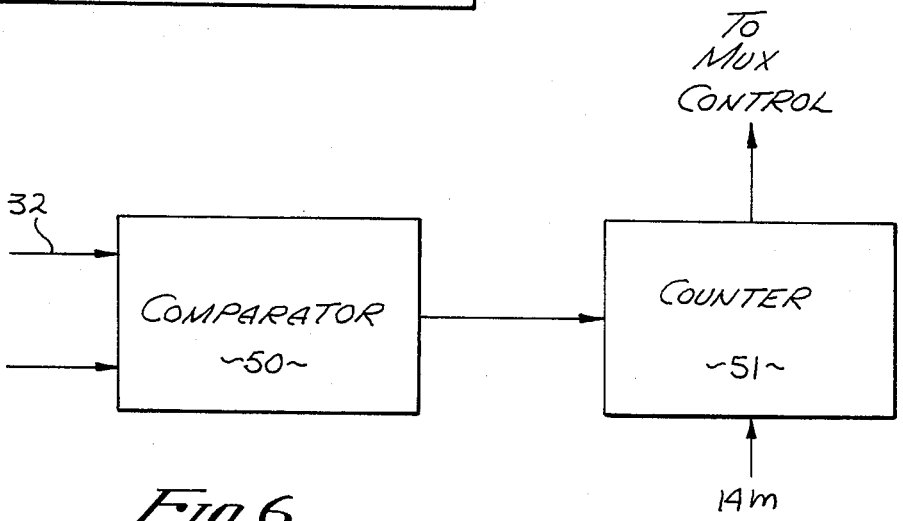
FIG. 6 is a block diagram illustrating an alternate embodiment of a portion of the apparatus of FIG. 4.

FIG. 6 illustrates an alternate apparatus. In FIG. 6, the incoming bit stream from line 32 is compared again with the corresponding bit in the previous color field (e.g., fourth stage of register 30). When a change is detected, the counter 51 counts a predetermined number of counts (e.g., 1, 2 or 3 for the four bit field). During the time when the counter is counting, the multiplexer selects the output of the latch, that is, the previous color is used for 1, 2 or 3 cycles of the 14 mHz clock.

EXAMPLE OF THE OPERATION OF THE INVENTION ON A BIT STREAM

Figure 5:
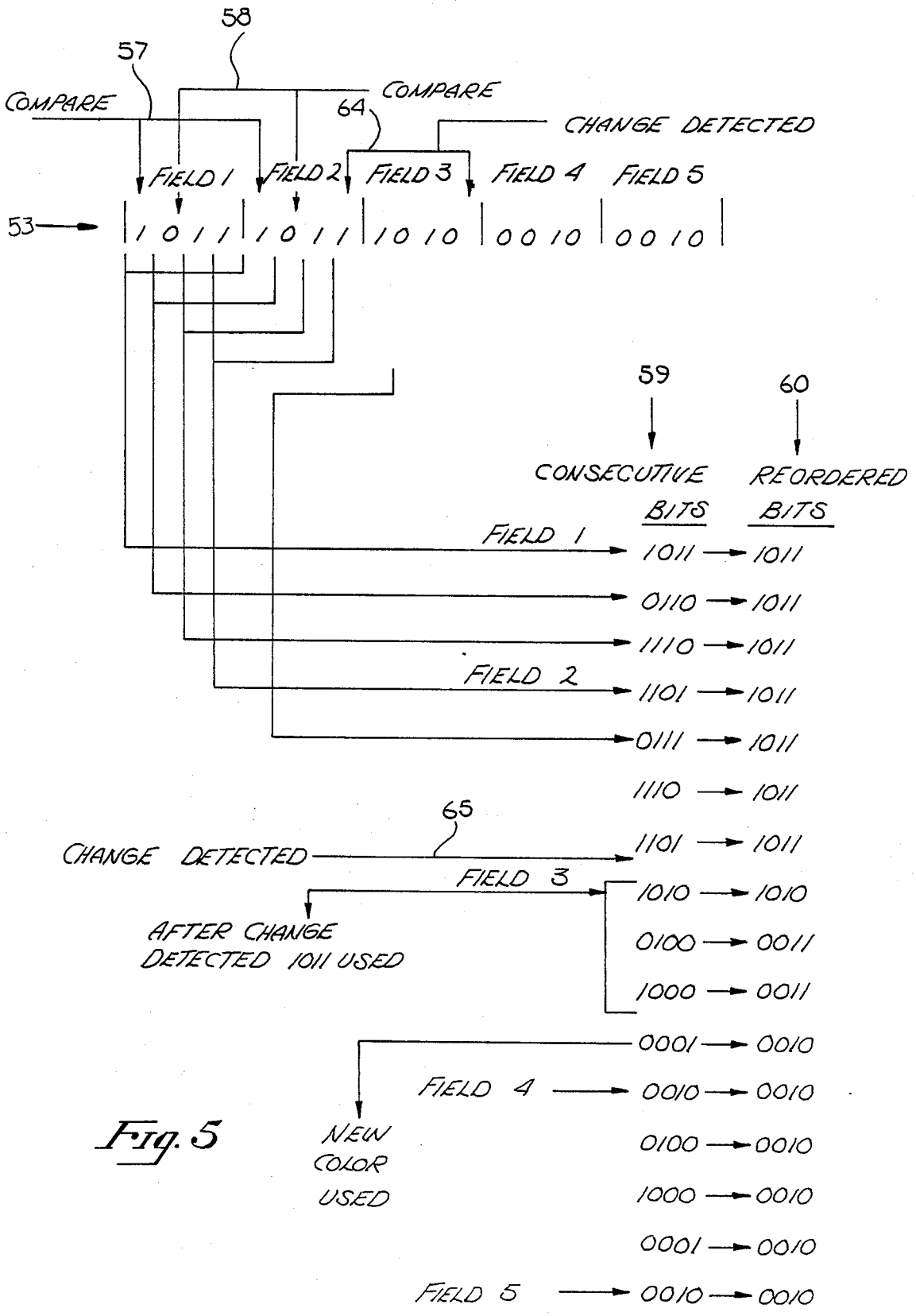
FIG. 5 shows a serial bit stream and the manipulation of the bits within the stream. This figure is used to describe the operation of the apparatus of FIG. 4.

A typical bit stream 53 is shown in FIG. 5 Five consecutive fields of the bit stream are shown with fields 1 and 2 providing a first color and fields 3 and 4 a second color. Field 3 is a transitional field where the color is changing; the first two bits of field 3 being in effect part of the first color and the second two bits of field 3 being part of the second color.

The bits which are compared with the apparatus of FIG. 4 are shown by the pointers 57 and 58. The "windowed" bit fields at the output of the shift register 30 are shown in column 59 of FIG. 5. The reordered bits are shown in column 60. These are the bits which appear at the output of the barrel shifter 31 of FIG. 4 and provide a color for each new bit in the bit stream.

For the bit stream of FIG. 5, the color defined by the bits 1011 is initially used for RGB control. No change in the bit stream colors is detected until the last bit of field 2 is compared with the last bit of field 3, this is shown with the pointer 64. This change occurs in columns 59 and 60 as indicated by the arrow 65. As soon as this change is detected, the color 1011 is repeated since the multiplexer then selects the output of the latch. Note that at this time, the output of the barrel shifter is 1010 then changing to 0011 for two counts, and then to 0010.

Assume the embodiment of FIG. 6 is in use. The counter 51 counts, for example, 3 counts or cycles. After the third count, the color 0010 is used as shown in FIG. 5. Thus, the fringe colors are not displayed.

Thus, an improved method and apparatus for converting a serial bit stream representing a composite color video signal to parallel color control signals has been described.

I claim:

1. A method for converting a bit stream representing color codes of a video signal to separate color control signals comprising the steps of:

determining from changing patterns of bits in said bit stream when a color change is occurring;

examining fields in said bit streams to detect one of a set of predetermined colors;

using the one of said set of predetermined colors for generating said color control signals detected prior to said determination of said color change until said color change is complete;

whereby better transition from one color to another color results.

2. The method defined by claim 1 wherein said completion of said color change is determined by the passage of a certain number of bits in said bit stream.

3. In a method for converting a bit stream representing a color video signal to red, green, and blue (RGB) color control signals for a RGB monitor or color printer where consecutive fields of bits in said bit stream represent codes for predetermined colors, an improvement comprising the steps of:

examining fields of bits in said bit stream to determine when a color change occurs;

examining fields of bits in said bit stream to determine said predetermined colors;

using one of the predetermined colors detecting prior to said determination of said color change until the passage of a certain number of bits is detected in said bit stream, then switching to the changed color;

whereby better transition from one color to another color results.

4. The method defined by claim 3 wherein said certain number of bits is at least one bit.

5. In a method for converting a bit stream representing a composite color video signal to red, green and blue (RGB) color control signals for a RGB color monitor or a color printer where consecutive fields of n bits in said bit stream represent codes for predetermined colors, an improvement comprising the steps of:

determining from changing patterns of bits in said bit stream when a color change is occurring;

examining fields of n bits where a new field of n bits is formed for every bit in said bit stream, said examining being used to detect one of said predetermined colors;

using one of the predetermined colors detected prior to said determination of said color change until said color change is complete;

whereby better transition from one color to another color occurs.

6. The method defined by claim 5 wherein said completion of said color change is determined by the presence of a certain number of bits.

7. The method defined by claim 6 wherein said certain number of bits is at least one bit.

8. The improvement defined by claim 5 wherein the bits are shifted in a rotate shift prior to said examining.

9. In a method for converting a bit stream representing a composite color video signal to a parallel control signals for a color monitor or color printer where consecutive color fields in said bit stream represent codes for predetermined colors and wherein each field comprises a certain number of bits, an improvement comprising;

comparing the nth bit of one of said fields with the nth bit of the next of said fields;

detecting a change in said nth bits of said one field and said next field; and, maintaining the color associated with said one field when said change is detected, then switching to the changed color;

whereby better transition from one color to another color occurs.

10. The method defined by claim 9 wherein a color determination is made by using n consecutive bits in said bit stream and with each new bit in said bit stream, the last n bits in said bit stream are examined to detect one of said predetermined colors.

11. The improvement defined by claim 10 including the step of shifting bits in a rotate shift before maintaining one of said predetermined colors.

12. In a method for converting a bit stream representing a composite color video signal to red, green and blue (RGB) color control signals for a RGB color monitor or color printer where each four bit field in said bit stream represents codes for a predetermined color, an improvement comprising the steps of:

determining from changing patterns of bits in said bit stream when a color change occurs;

examining groups of four bits where a group of four bits is formed for every new bit in said bit stream for detecting said predetermined colors;

using one of the predetermined colors detected prior to said determination of said color change until the passage of a certain number of bits is detected, then switching to the changed color;

whereby better transition from one color to another color results.

13. The method defined by claim 12 wherein said certain number of bits is at least one bit.

14. The improvement defined by claim 12 wherein the bits in every consecutive three fields of said bits are rearranged prior to said examining.

15. In an apparatus for converting a serial bit stream representing color codes of a video signal to parallel control signals for a video display, an improvement comprising:

comparator means for comparing bits in said field to detect when a color change occurs;

examination means for loading bits from said serial bits stream and examining consecutive bit fields of said bit stream to detect predetermined colors, coupled to said comparator means;

control means coupled to said comparator means and said examination means for substituting the one of said predetermined colors detected prior to said color change until the passage of a certain number of bits is detected and for switching to the next color;

whereby smooth transition from one color to another results.

16. The improvement defined by claim 15 including shift register coupled to said examination means for permitting each consecutive group of n bits in said bit stream to be examined.

17. The improvement defined by claim 16 including rearranging means for rearranging bits prior to their examination by said examination means.

18. The improvement defined by claim 17 wherein said examination means and rearranging means comprise a shift register and barrel shifter, respectively.

19. An apparatus for converting a serial bit stream representing color codes of a composite video signal to parallel control signals for a color monitor or color printer comprising:

a shift register for receiving said bit stream and for providing a first parallel output;

a barrel shifter coupled to said shift register for receiving said parallel output, said barrel shifter providing a second parallel output;

comparator means for comparing said bit stream coupled to said shift register and one of said first parallel outputs of said shift register, said comparator means providing a control signal;

multiplexer means coupled to said second parallel output for receiving a first input from said barrel shifter;

storage means for storing a digital signal coupled to the output of said multiplexer, the output of said storage means being coupled to the input of said multiplexer so as to provide a second input to said multiplexer;

said multiplexer being controlled by said control signal from said comparator means, said multiplexer for providing either said first input or said said second input as an output;

whereby the output of said storage means is recirculated through said multiplexer means when said color change occurs providing for a smooth color transition.

20. The apparatus defined by claim 19 wherein said barrel shifter receives a color reference signal associated with said color monitor as a control signal to control shifting within said barrel shifter.

21. The apparatus defined by claim 17 wherein said barrel shifter also receives a control signal which is twice said color reference frequency.

* * * * *